US010066916B1

(12) United States Patent
Vabnick et al.

(10) Patent No.: US 10,066,916 B1
(45) Date of Patent: Sep. 4, 2018

(54) LOW IMPACT THREAT RUPTURE DEVICE FOR EXPLOSIVE ORDNANCE DISRUPTOR

(71) Applicant: The United States of America as Represented by the Secretary of the Navy, Washington, DC (US)

(72) Inventors: Ian Vabnick, Quantico, VA (US); Arthur Ellis, Swan Point, MD (US); Joe Rothenberger, King George, VA (US); Chad Smith, King George, VA (US); Mike Sharp, King George, VA (US); Lee Foltz, Indian Head, MD (US); Eric Morefield, Quantico, VA (US); Barry Black, Oklahoma City, OK (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/330,137

(22) Filed: Aug. 15, 2016

(51) Int. Cl.

| | |
|---|---|
| ***F42B 12/74*** | (2006.01) |
| ***F42D 5/04*** | (2006.01) |
| ***F42B 33/06*** | (2006.01) |
| ***F42B 8/04*** | (2006.01) |

(52) U.S. Cl.
CPC ..... *F42B 33/067* (2013.01); *F42B 8/04* (2013.01); *F42B 12/74* (2013.01); *F42D 5/04* (2013.01)

(58) Field of Classification Search
CPC ..... F42B 8/04; F42B 12/74; F42B 33/067; F42B 33/06; F42B 33/062; F42B 12/02
USPC ..... 86/50–52, 1.1; 42/1.14, 1.15, 51; 124/56, 61, 63, 64; 89/1.13, 1.34, 1.3, 5, 89/7
See application file for complete search history.

(56) References Cited

U.S. PATENT DOCUMENTS 2,491,516 A * 12/1949 Piggot ..... F42B 33/06 134/167 R
4,046,055 A * 9/1977 McDanolds ..... F42B 33/06 102/293

(Continued)

FOREIGN PATENT DOCUMENTS

ES 2083894 A2 * 4/1996
GB 2083894 3/1982

OTHER PUBLICATIONS

AB Precision (Poole) Ltd., Explosive Ordnance Disposal, ABL 900, Jan. 2009, United Kingdom.

(Continued)

*Primary Examiner* — John Cooper
(74) *Attorney, Agent, or Firm* — Fredric Zimmerman

(57) ABSTRACT

An EOD disruptor system for penetrating steel encased explosive devices has a barrel and a blank cartridge loaded in the EOD disruptor. A water column is disposed in the barrel in front of the blank cartridge. A water plug is disposed in front of the water column. A muzzle-loaded projectile is disposed in front of the water plug. The projectile includes a shaft portion at least partially disposed in the barrel and a front portion disposed outside of the barrel. The shaft portion may have a length from about four inches to about eighteen inches. The projectile may have a weight from about four ounces to about two pounds. The ratio of the length of the shaft portion of the projectile to the inner barrel diameter may be in a range of about two to about 50.

16 Claims, 4 Drawing Sheets

(56) References Cited

U.S. PATENT DOCUMENTS

| | | | | |
|---|---|---|---|---|
| 6,439,127 | B1 * | 8/2002 | Cherry | F42B 12/36 102/402 |
| 6,644,166 | B2 * | 11/2003 | Alexander | F41B 11/00 102/275.11 |
| 8,276,495 | B1 * | 10/2012 | Chiu | F41A 21/485 42/1.08 |
| 9,404,718 | B1 * | 8/2016 | Shaver | F41B 9/0046 |
| 2011/0061521 | A1 * | 3/2011 | Gardner | F41A 23/28 89/1.13 |

OTHER PUBLICATIONS

AB Precision (Poole)Ltd., Explosive Ordnance Disposal, ABL 2000, Jan. 2009, United Kingdom.

Nexus Defense, ABL 3000 Recoiless Disrupter & De-Armer, Publication Date unknown, United Kingdom, accessed on Feb. 4, 2018 at http://www.nexus-defence.com.

* cited by examiner

LOW IMPACT THREAT RUPTURE DEVICE FOR EXPLOSIVE ORDNANCE DISRUPTOR

STATEMENT OF GOVERNMENT INTEREST

The invention described herein may be manufactured and used by or for the Government of the United States of America for Governmental purposes without the payment of any royalties thereon or therefor.

FIELD OF THE INVENTION

The invention relates in general to explosive ordnance disposal (EOD) and in particular to projectiles for EOD disruptors, including but not limited to percussion activated non-electric (PAN) disruptors and electrically initiated EOD disruptors.

BACKGROUND OF THE INVENTION

Some known improvised explosive device (IED) threats and newly emerging IED threats use steel-cased devices containing thermal and/or impact sensitive propellants or thermal or impact sensitive explosives. Currently used render safe procedures (RSPs) carried out with gun-type EOD disruptors use high velocity steel or other metal or metal composite projectiles moving in excess of 2000 fps to vent hard cased IEDs. The unexpected consequences of this approach are the tremendous pressures and shock waves that are produced. For example, steel projectiles that hit steel targets have matched shock impedances and thus efficiently propagate shock waves. Such shock waves can compress the explosives that fill the IED. The explosives are pressed against the side of the casing in the projectile impact zone.

The explosives' compression occurs quickly and adiabatic conditions are created. For example, after projectile impact, black powder inside an IED can be compressed and heated to ignition, resulting in an IED exploding and fragmenting. In the case of double and triple-based smokeless powder, the nitroglycerin-containing propellant detonates immediately after the projectile hits the IED. The RSP creates an explosion that is far more violent and lethal than if the IED simply functioned as designed. Most IEDs are initiated through pyrotechnic fuzes or electric matches. Of particular concern are steel capped pipe bombs, steel plugged elbow pipe bombs, and improvised grenades.

A conventional technology may pierce relatively thin-walled steel containers, for example, a steel drum or a steel ammo box, without initiating the explosive therein. Even so, such conventional technology cannot pierce, for example, 2 inch diameter schedule 40 steel cased pipe bombs. A need exists for EOD projectiles that can penetrate a relatively thick steel case of an explosive device without detonating the explosives in the device.

SUMMARY OF THE INVENTION

One aspect of the invention is an apparatus that includes an EOD disruptor with a barrel. A blank cartridge may be loaded in the EOD disruptor. A water column may be disposed in the barrel in front of the blank cartridge. A water plug may be disposed in front of the water column. The apparatus may include a muzzle-loaded projectile having a central longitudinal axis and disposed in front of the water plug. The projectile includes a shaft portion at least partially disposed in the barrel and a front portion disposed outside of the barrel. A ratio of the length of the shaft portion to the inner barrel diameter may be in a range of about two to about fifty. The projectile may have a weight from about four ounces to about two pounds.

In some embodiments, the entire shaft portion of the projectile may be disposed in the barrel. In other embodiments, the amount of the shaft portion that is disposed in the barrel is variable.

Various embodiments of the projectile include a shaft portion with a sub-caliber diameter. In these embodiments, the projectile may include least one bushing slidably mounted on the shaft portion.

A restraint system may be included for limiting the distance travelled by the projectile.

Another aspect of the invention is a method that includes providing the novel apparatus and firing the projectile from the EOD disruptor with a muzzle velocity of less than about 1000 feet per second. Before firing, the shaft portion may be situated fully or partly in the barrel.

The invention will be better understood, and further objects, features, and advantages thereof will become more apparent from the following description of the exemplary embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE INVENTION

Figure 1:
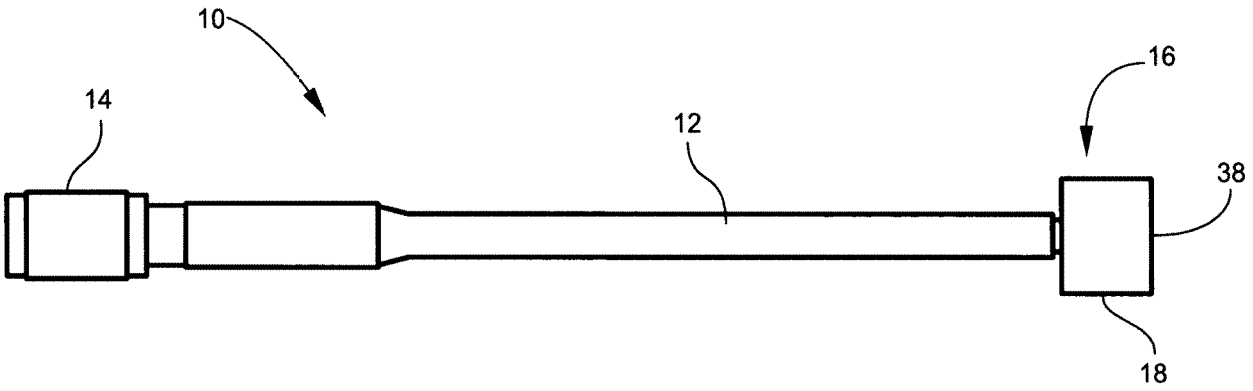
FIG. 1 is a side view of one exemplary embodiment of an EOD disruptor loaded with a muzzle-loaded projectile that has a front portion disposed outside the barrel.
Figure 2:
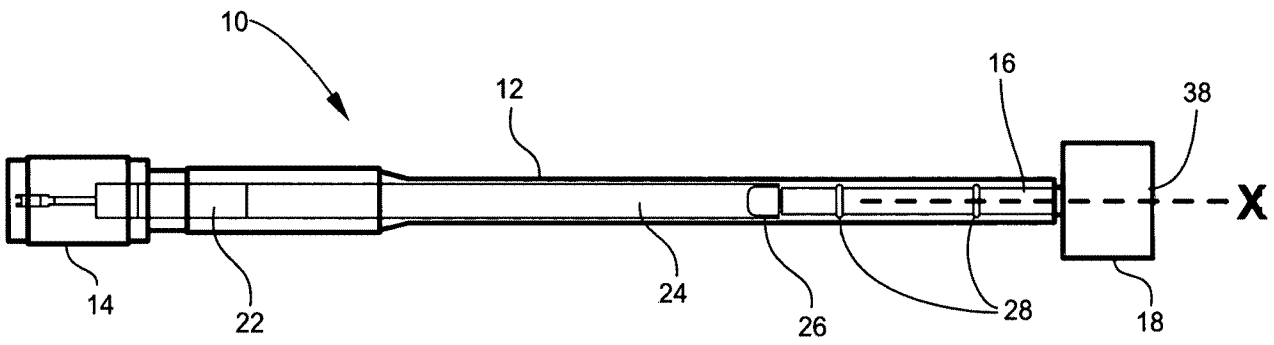
FIG. 2 is a cutaway view of the embodiment shown in FIG. 1.
Figure 3:
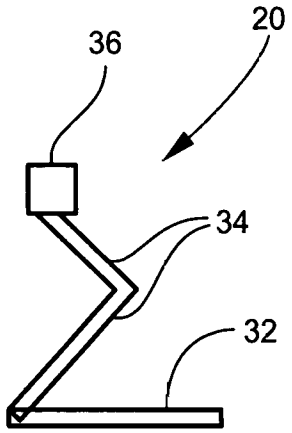
FIG. 3 Conventional Art
FIG. 3 is a schematic of one embodiment of a conventional fixed mount stand for an EOD disruptor.

FIGS. 1 and 2 show an EOD disruptor 10. In one exemplary embodiment, disruptor 10 is a 12 gauge PAN disruptor having a barrel 12 and a breech 14. The disruptor 10 may be mounted to a known fixed mount stand 20 (FIG. 3). The disruptor 10 may tolerate breech pressures in excess of 50,000 psi. Stand 20 may include a base portion 32, articulating arms 34 and a mount 36. A 12 gauge blank cartridge 22 may be loaded in breech 14 of disruptor 10. A water column 24 may be disposed in the barrel 12 in front of the blank cartridge 22. A water plug or wadding 26 may be disposed in front of the water column 24. A muzzle-loaded projectile 16 may be disposed in front of the water plug 26.

Projectile 16 may be made of, for example, steel, tungsten, metal alloys, and composites. Different portions of the projectile 16 may be made of different materials. The projectile 16 includes a generally cylindrical shaft portion 30 at least partially disposed in the barrel 12 and a front portion 18 disposed outside of the barrel 12. In the embodiment shown, the front portion 18 includes a beveled cutting edge 38, such that the projectile 16 resembles a chisel. In other exemplary embodiments, front portion 18 may be a forked blade, a blunt cylindrical end, an ogive shape, a pyramidal shape with up to four cutting edges, or a shape with rows of pyramidal shaped teeth, for example. A forked blade is effective at cable, wire and detonation cord cutting. A bushing tool with pyramidal shaped teeth is effective at removing the external end caps from pipe bombs. Projectile 16 may be coated with a non-sparking and friction reducing material, for example, cutting oil or Cerakote™. Projectile 16 may also be placed in a plastic sheath such as a sabot-style covering to enable the use of reduced diameter projectile shafts in the barrel.

In the embodiment shown in FIGS. 1 and 2, the entire shaft portion 30 is disposed in the barrel 12. In the embodiment shown in FIG. 4, only part of the shaft portion 30 is disposed in the barrel 12. The portion of the shaft portion 30 that is external to the barrel can extend up to 12 inches beyond the muzzle. In some embodiments, the shaft portion 30 has a length of about four inches to about eighteen inches. More particularly, the shaft portion 30 has a length of about eight to fourteen inches. The ratio of the length of shaft portion 30 to the inner barrel diameter may be greater than 2 and may be as high as 50. In some embodiments, the projectile 16 has a weight from about four ounces to about two pounds. More particularly, the projectile 16 has a weight from about twelve ounces to about twenty-four ounces.

The projectile mass distribution may be non-uniform. The majority of the mass may be placed on the head of the projectile such that the center of pressure and gravity are at the same location. This mass distribution creates a center of mass front of center, which allows for stable flight for projectiles ejected from smooth-bored barrels. The projectile 16 may be symmetric about its central longitudinal axis X (FIG. 2) to maximize contact duration with the target IED.

Figure 4:
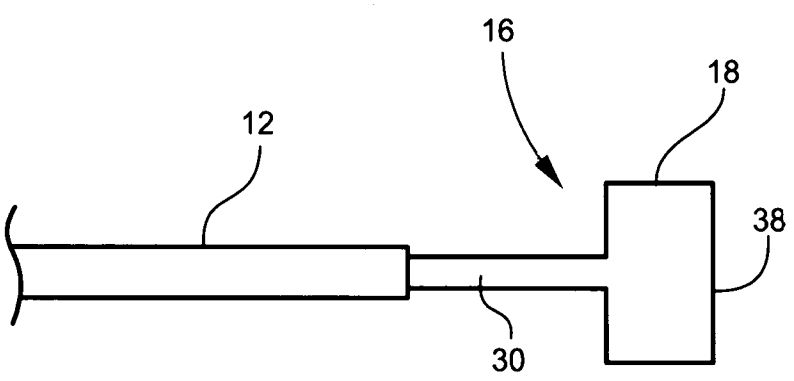
FIG. 4 is a partial side view of the EOD disruptor of FIG. 1 showing the muzzle-loaded projectile with less than the entire shaft portion disposed in the barrel.

In the embodiment shown in FIGS. 1, 2 and 4, shaft portion 30 has a diameter of about 0.70 inches, corresponding to an approximate sliding fit in a 12 gauge barrel. As seen in FIG. 2, the shaft portion 30 may include one or more O-rings 28 mounted thereon to provide a friction fit inside the barrel 12. Circumferential grooves (not shown) may be provided on shaft portion 30 for seating O-rings 28. Other methods may be used to enable different amounts of shaft portion 30 to be disposed in barrel 12. For example, a piece of electrical tape may be wound around a location on shaft portion 30 to provide a friction fit in barrel 12. The amount of shaft portion 30 that is disposed in barrel 12 may be varied. In general, increasing the amount of shaft portion 30 in barrel 12 increases the muzzle velocity of projectile 16.

Figure 5:
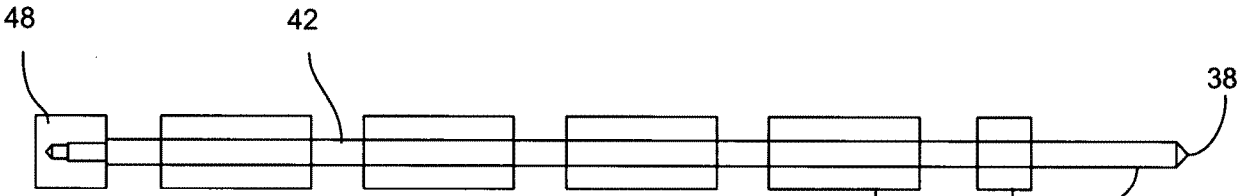
FIG. 5 is a side view of another exemplary embodiment of a projectile for an EOD disruptor.
Figure 6:
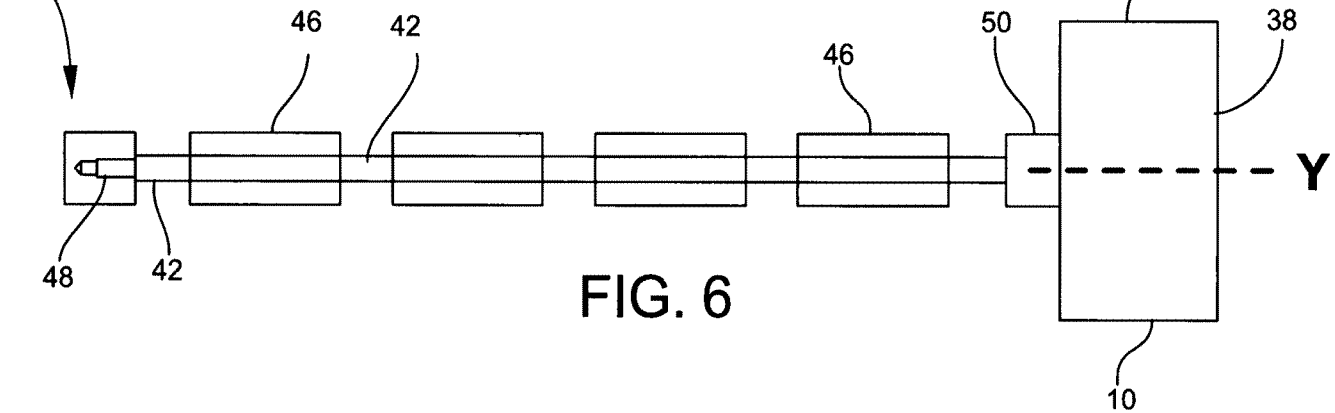
FIG. 6 is a top view of the projectile of FIG. 5.
Figure 7:
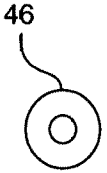
FIG. 7 is an end view of one exemplary embodiment of a bushing that is used with the projectile of FIGS. 5-6.

FIG. 5 is a side view of another embodiment of a projectile 40 for a disruptor 10. FIG. 6 is a top view of the projectile 40 of FIG. 5. Projectile 40 may include a shaft portion 42 and a front portion 44. Projectile 40 may be symmetrical about a central longitudinal axis Y. The shaft portion 42 may be cylindrical and may have a sub-caliber diameter. The projectile 40 may include at least one bushing 46 slidably mounted thereon. FIG. 7 is an end view of a bushing 46. Bushings 46 may be retained on shaft portion 42 by an end piece 48. End piece 48 may engage shaft portion 42 with threads. End piece 48 may be removed to add or remove bushings 46 from shaft portion 42. End piece 48 and forward piece 50 may be approximately full caliber diameter pieces to provide a friction fit of projectile 40 in barrel 12. Projectile 40 may be coated with a non-sparking and friction reducing material, for example, cutting oil or Cerakote™.

In the embodiment shown, four bushings 46 are shown, but more or fewer bushings 46 may be used. Bushings 46 may be made of, for example, steel or tungsten. In the embodiment shown, bushings 46 may have an outside diameter of about 0.70 inches. The length of each bushing 46 may be in a range of about 0.5 inches to about 1.5 inches. A combined length of bushings 46 may be in a range of about 1 inch to about 9 inches.

The front portion 44 of projectile 40 may be disposed outside of the barrel 12. In the embodiment shown, the front portion 44 includes a beveled cutting edge 38. In other embodiments, front portion 44 may be a forked blade, a blunt cylindrical end, an ogive shape, a pyramidal shape with up to four cutting edges, or a shape having rows of pyramidal shaped teeth, for example. In some embodiments, the shaft portion 42 may have a length of about four inches to about eighteen inches. More particularly, the shaft portion 42 may have a length of about eight to fourteen inches. The ratio of the length of shaft portion 42 to the inner barrel diameter may be greater than 2 and may be as high as 50. In some embodiments, the projectile 40 may have a weight from about four ounces to about two pounds. More particularly, the projectile 40 may have a weight from about twelve ounces to about twenty-four ounces.

When projectile 40 is fired from disruptor 10, the bushings 46 are pushed rearward on shaft portion 42. When projectile 40 impacts a target, the bushings 46 slide forward and provide a second series of pressure waves and thus increase the time the projectile is pushing through the target barrier. This additional impulse allows one to reduce the strength of the blank cartridge 22 to thereby reduce the recoil of the disruptor 10. Sometimes, the disruptor recoil may be too great for deploying the disruptor with a robot. If the disruptor recoil is decreased, robotic deployment may be possible.

Projectiles 16, 40 may be fired from disruptor 10, or any other gun-type EOD disruptor having an appropriately pressure rated breech, with a muzzle velocity of less than about 1000 feet per second. More particularly, the muzzle velocity may be less than about 500 feet per second.

Figure 8:
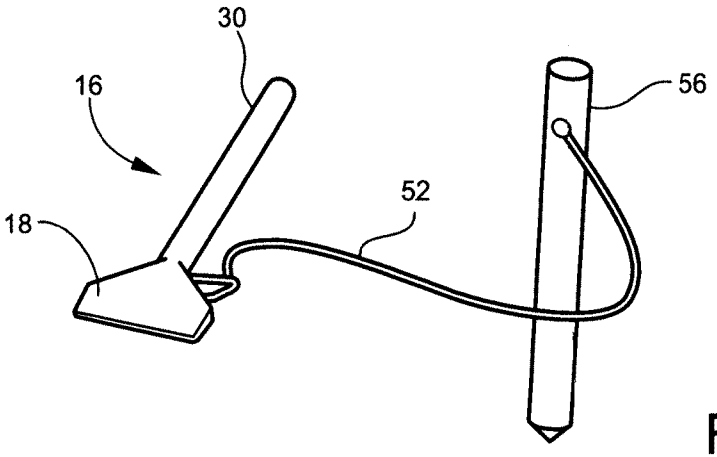
FIG. 8 is a perspective view of a muzzle-loaded projectile with one embodiment of a restraint system.
Figure 9:
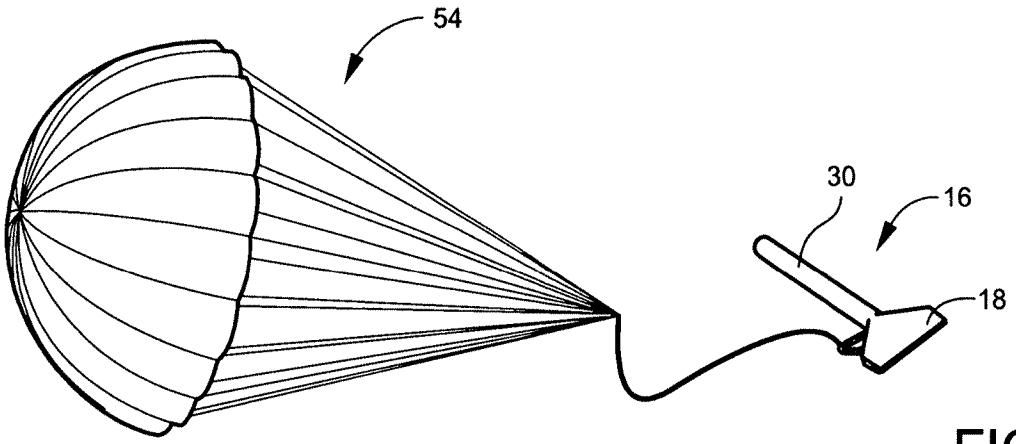
FIG. 9 is a perspective view of a muzzle-loaded projectile with a second exemplary embodiment of a restraint system.

To limit the down range hazard of projectiles 16, 40, a restraint system may be employed, such as a tether 52 (FIG. 8) or parachute 54 (FIG. 9). Projectiles may have residual momentum after impact with a target and may fly down range and create a hazard to life and property. A restraint system will limit how far the projectile can travel. The tether 52 can be anchored to the ground with a stake 56 or a weight (not shown) and placed nearby the disruptor 10. The parachute 54 or tether 52 is connected to the projectile via an attachment that is rated for the dynamic stress produced during flight after impact. The parachute connection or tether must be long enough so the restraint system is not active until after the projectile has hit the target.

Test Results

Testing has verified that lowering the velocity of a PAN projectile and increasing its mass and length can dramatically reduce the likelihood of ignition of IEDs and eliminate detonation of smokeless powder inside IEDs. A small decrease in velocity results in a much larger decrease in shock pressure because the pressure is proportional to the square of the projectile velocity.

For capped pipe bombs, a conventional defeat method uses the frangible AVON projectile (1 ounce of steel shot, 2,000 fps). Capped pipe bombs also have been defeated using the Remington Nitroturkey™ shot shell (2 ounces of lead shot, 1300 fps). The Nitroturkey™ shot shell was not effective at defeating plugged elbow pipe bombs. Ignition and fragmentation resulted. It was believed that the projectile needed to have an even lower velocity to avoid shock conditions and compressive heating, which occur when the pressure wave moves faster than the speed of sound in the impacted material.

The inventive projectile manipulates the projectile momentum transfer (impulse) to cut through the pipe elbow and knock out the plug. The impact force needs to be greater than the yield strength of the steel case. The projectile velocity was lowered to approximately 300 fps or less. The lower velocity reduced the impact pressure and did not produce shock waves, yet the projectile penetrated the elbow and knocked out the plug. Compared to a conventional steel slug projectile, the mass of the inventive test projectile was increased about 24 times. The steel slug projectile is used in the standard RSP. Tests showed that the steel slug failed 90% of the time.

The duration of collision of the projectile also was increased. The duration is proportional to 2L/C, where L is the projectile length and C is the speed of sound in the projectile. In the test projectile, the duration was increased 10 times compared to the steel slug projectile. To emphasize the importance of impact duration, theoretically, a 300 fps projectile of about 1.5 pounds having the length of a conventional steel slug would not rupture a plugged elbow. The dramatically increased length of the shaft portion of the novel projectile was proven to be ideal for steel pipe bombs and nipture and defeat of other kinds of IEDs.

The shaft length and projectile velocity are not mutually exclusive. It has been demonstrated that the velocity of the projectile is approximately proportional to the projectile depth in the barrel. Using a shaft portion approximately ten inches long seated the novel projectile deep enough into the disruptor barrel to create the required muzzle velocity of 300 fps.

Projectile tip profile also has an effect on penetration. Decreasing the cross sectional area of a projectile tip results in greater projectile penetration through a barrier. While a blade shaped projectile head increases the impact pressure, it has the benefit of reducing the material being compressed at the interaction region. The barrier yields quickly so the required impact duration is reduced and less energy is transformed into heat. The test projectile used a 3" wide blade (chisel head) to defeat 2" diameter steel capped and elbow plugged pipe bombs. Two inch diameter pipe fittings are commonly used in IEDs in the United States.

Because of the large length of the shaft portion of the novel projectile, the velocity of the projectile may be adjusted in a continuum of velocities by changing how deeply seated the shaft portion is placed in the barrel. This adjustment is not possible with a conventional short shaft, chisel head projectile.

The novel projectile may include a water column to its rear. The water column has been shown to double the energy output compared to a projectile that has an air gap between the back of the projectile and the blank cartridge. The water creates a hydraulic seal, which decreases propulsion gas blow-by and increases the propulsion gas pressure that drives the projectile forward. A secondary benefit of the water column is a fluid jet that follows the projectile and suppresses thermal effects on the target.

There are four conventional blank 12 gauge cartridges of different explosive strengths in common use: enhanced, high velocity, medium velocity and low velocity. Other commercial specialty blank cartridges are available. This variety of cartridges provides further flexibility in projectile velocity and impact pressure. Thinner skinned targets can be ruptured more gently and thus reduce the risk of ignition. Other specialty blank cartridges with different powder loads and type can be constructed using standard reloading techniques. These blank cartridges can customize the pressure time history of a projectile.

Any numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. An apparatus, comprising:

an EOD disruptor having a barrel;

a blank cartridge being loaded in the EOD disruptor;

a water column being disposed in the barrel in front of the blank cartridge; a water plug being disposed in front of the water column;

a muzzle-loaded projectile including a central longitudinal axis and being disposed in front of the water plug, wherein the projectile includes a shaft portion at least partially disposed in the barrel and a front portion disposed outside of the barrel, and wherein a ratio of a length of the shaft portion to an inner barrel diameter is in a range of two to fifty and the projectile has a weight from four ounces to two pounds, wherein the shaft portion is configured to be seated at variable depths within the barrel, so that an amount of the shaft portion disposed in the barrel is capable of being varied.

2. The apparatus of claim 1, wherein the shaft portion includes a length from four inches to eighteen inches.

3. The apparatus of claim 1, further comprising a fixed mount stand for mounting the EOD disruptor.

4. The apparatus of claim 1, wherein the entire shaft portion is disposed in the barrel.

5. The apparatus of claim 4, wherein the shaft portion includes a sub-caliber diameter, and wherein the projectile includes at least one bushing slidably mounted on the shaft portion.

6. The apparatus of claim 4, wherein the shaft portion includes a sub-caliber diameter, wherein the projectile includes at least one bushing slidably mounted on the shaft portion and wherein said at least one hushing includes an outside diameter of 0.70 inches.

7. The apparatus of claim 4, wherein the shaft portion includes a sub-caliber diameter, and wherein the projectile includes at least one bushing slidably mounted on the shaft portion, and wherein said at least one bushing is three bushings.

8. The apparatus of claim 4, wherein the shaft portion includes a sub-caliber diameter, wherein the projectile includes at least one bushing slidably mounted on the shaft portion, and wherein a length of said at least one bushing is one inch.

9. The apparatus of claim 1, wherein the EOD disrupter is a 12 gauge disrupter and the shaft portion has a diameter of 0.70 inches.

10. The apparatus of claim 1, wherein the shaft portion includes at least one 0-rings mounted thereon to provide a friction fit inside the barrel.

11. The apparatus of claim 1, wherein an amount of the shaft portion that is disposed in the barrel is variable.

12. The apparatus of claim 1, wherein the front portion includes a beveled cutting edge.

13. A method, comprising:

providing the apparatus of claim 1; and firing the projectile from the EOD disruptor with a muzzle velocity of less than 1000 feet per second, wherein the shaft portion is variable in length so that an amount of the shaft portion disposed in the barrel is capable of being varied.

14. The method of claim 13, wherein the step of firing the projectile includes firing the projectile with a muzzle velocity of less than 500 feet per second.

15. The method of claim 13, further comprising, before firing, situating the shaft portion fully in the barrel.

16. The method of claim 13, further comprising, before firing, situating the shaft portion only partly in the barrel.

* * * * *